US007000428B2

(12) United States Patent
Kamara et al.

(10) Patent No.: US 7,000,428 B2
(45) **Date of Patent: *Feb. 21, 2006**

(54) JEWELRY WITH BATTERY-ILLUMINATED MEDALLION

(75) Inventors: Michael A. Kamara, Sherman Oaks, CA (US); Heather Dadmanesh, Alexandria, VA (US)

(73) Assignee: Firejewel, LLC, Rockville, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/634,025

(22) Filed: Aug. 4, 2003

(65) Prior Publication Data

US 2004/0025536 A1 Feb. 12, 2004

Related U.S. Application Data

(63) Continuation of application No. 09/827,028, filed on Apr. 4, 2001, now Pat. No. 6,601,965, which is a continuation-in-part of application No. 09/498,523, filed on Feb. 4, 2000, now abandoned.

(51) Int. Cl.
*A44C 5/00* (2006.01)
*F21L 15/08* (2006.01)

(52) U.S. Cl. ..... 63/3; 63/3.1; 362/104; 362/571

(58) Field of Classification Search ..... 63/1.11, 63/1.12, 1.13, 1.14, 13, 3, 3.1, 18, 23; 362/570, 362/571, 104, 252, 311, 351, 355, 356, 363, 362/800, 565, 103, 108, 806–809
See application file for complete search history.

(56) References Cited

U.S. PATENT DOCUMENTS 3,968,357 A * 7/1976 Hamilton ..... 362/104
4,012,629 A * 3/1977 Simms ..... 362/104
4,101,955 A * 7/1978 DuNah ..... 362/104
4,170,036 A * 10/1979 Sussel ..... 362/104
4,186,425 A * 1/1980 Nadimi ..... 362/571
4,262,324 A * 4/1981 Murphy ..... 362/104
4,271,457 A * 6/1981 Martin ..... 362/104
4,459,645 A * 7/1984 Glatter ..... 362/104
4,779,172 A * 10/1988 Jimenez et al. ..... 362/104
4,894,757 A * 1/1990 Frusha et al. ..... 362/104
5,018,053 A * 5/1991 Belknap et al. ..... 362/104
5,140,220 A * 8/1992 Hasegawa ..... 313/512
5,477,433 A * 12/1995 Ohlund ..... 362/104
5,497,307 A * 3/1996 Bae et al. ..... 362/104
5,567,037 A * 10/1996 Ferber ..... 362/104
5,653,530 A * 8/1997 Pittman ..... 362/307
5,876,109 A * 3/1999 Scalco ..... 362/104
5,934,784 A * 8/1999 Dion ..... 362/103
5,951,158 A * 9/1999 Upah ..... 362/571
6,122,933 A * 9/2000 Ohlund ..... 63/3
6,233,971 B1 * 5/2001 Ohlund ..... 63/3
6,238,056 B1 * 5/2001 Rapisarda ..... 362/103
6,296,364 B1 * 10/2001 Day et al. ..... 362/104
6,626,009 B1 * 9/2003 Ohlund ..... 63/3.1

* cited by examiner

*Primary Examiner*—Jack W. Lavinder
(74) *Attorney, Agent, or Firm*—Lieberman & Brandsdorfer, LLC

(57) ABSTRACT

A necklace or bracelet includes a luminous medallion. A conductor having a coating of non-conductive material is formed into a loop having two discontinuities. A clasp that houses a removable battery is fixed within the first discontinuity and a bead having an internally embedded LED is located within the second discontinuity. Electrical connections are made to electrodes located within the clasp by interior electrical conductors exposed at the stripped ends of the coated conductors that define one discontinuity. The conductors are fixed in electrical contact with the LED at the other discontinuity at the stripped ends of the coated conductor in the region of the second discontinuity.

14 Claims, 2 Drawing Sheets

JEWELRY WITH BATTERY-ILLUMINATED MEDALLION

CROSS REFERENCE TO RELATED APPLICATION(S)

The present application is a continuation of U.S. patent application Ser. No. 09/827,028, filed Apr. 4, 2001 now U.S. Pat. No. 6,601,965 which is a continuation-in-art of U.S. patent application Ser. No. 09/498,523, filed Feb. 4, 200 now abandoned.

BACKGROUND OF THE INVENTION

1. Technical Field

This invention relates to jewelry. More particularly, this invention pertains to a necklace or bracelet that includes an illuminated medallion.

2. Description of the Prior Art

There exists a substantial market for jewelry of a whimsical nature. Unfortunately, the design of jewelry that can be sold at mass market prices while offering an eye catching effect, such as artificial luminance, is complex and difficult. To achieve such an effect, the jewelry must include a power source, preferably compact. In addition, inexpensive prior art jewelry incorporating a battery-powered device has generally been of limited useful life since inexpensive designs fail to permit battery replacement.

SUMMARY OF THE INVENTION

The present invention addresses the foregoing and other shortcomings of the prior art by providing an article of jewelry. Such article includes an elongated flexible conductor having an exterior coating of non-conductive composition. The conductor comprises a loop having first and second internal discontinuities. A clasp is located within the first discontinuity and a medallion is located within the second discontinuity. The clasp includes a battery in electrical communication with the conductor, and the medallion includes an electro-luminous device in electrical communication with the conductor.

The preceding and other features and advantages of the present invention shall become further apparent from the detailed description that follows. Such description is accompanied by a set of drawing figures in which numerals, corresponding to those of the written description, are associated with the features of the invention. Like numerals refer to like features throughout both the written description and the drawing figures.

DESCRIPTION OF THE PREFERRED EMBODIMENT

Technical Details

Figure 1:
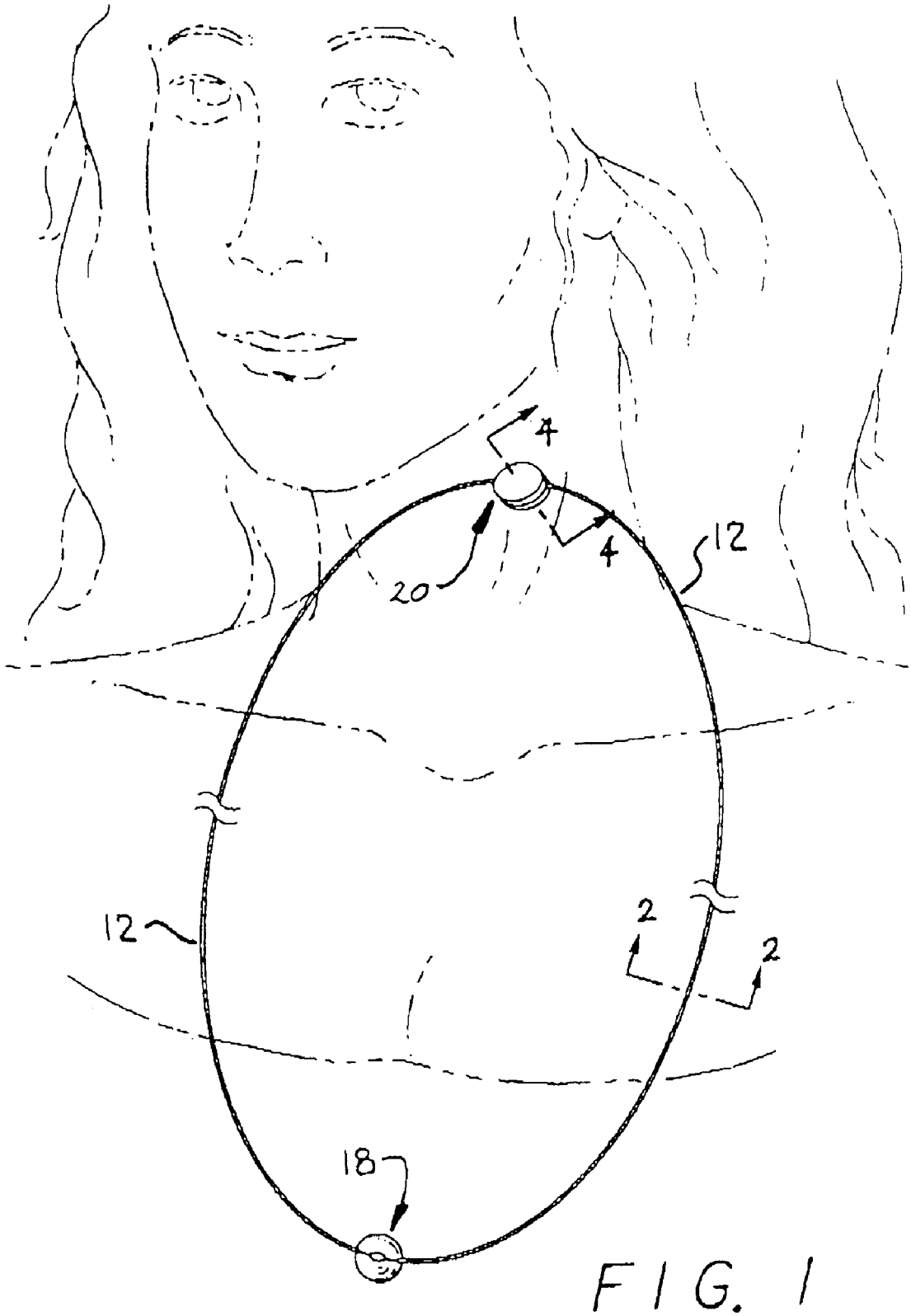
FIG. 1 is a perspective view of a necklace incorporating the invention superimposed upon a wearer shown in shadow outline.
Figure 2:
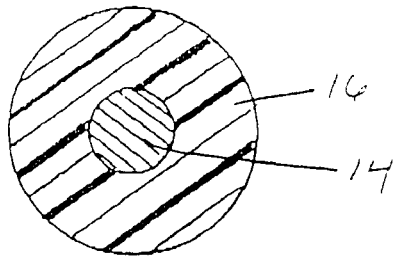
FIG. 2 is a cross-sectional view of the coated conductor of the invention.

Turning to the drawings, FIG. 1 is a perspective view of a necklace 10 incorporating the invention superimposed upon a wearer shown in shadow outline. The necklace 10 generally comprises a coated conductor 12 comprising, as shown in the cross-sectional view of FIG. 2, an internal conductor or wire 14 having a coating 16 of appropriate non-conductive material. An example of a suitable coated conductor is NYLON coated wire. Such a conductor has the advantageous quality of avoiding "kinking" when bent.

Returning to FIG. 1, the coated conductor 12 is formed into a loop for hanging about a wearer's neck, in the case of the necklace, or wrist, in the case of a bracelet, with discontinuities provided for incorporation of an illuminated medallion 18 and a clasp 20 housing a battery structure. As will be seen, an electrical circuit is formed that includes the battery housed within the clasp 20, a battery-powered light emitting device of the medallion 18 and the conductor 14. Such electrical circuit actuates the medallion to emit illumination when energized by the closing of the clasp 20. Thus the clasp 20 serves both to secure the necklace 10 and to house a replaceable battery. By allowing battery replaceability, the useful life of the necklace 10 is not limited by that of the battery, permitting the fabrication of higher quality jewelry as opposed to the lower quality "throw away" items of the prior art.

Figure 3:
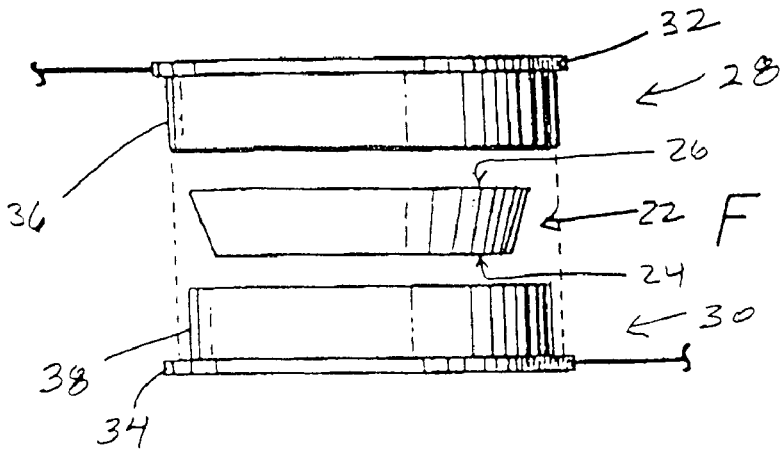
FIG. 3 is an exploded side elevation view of the clasp of an article of jewelry in accordance with the invention, according to the preferred embodiment of this invention, and is suggested for printing on the first page of the issued patent.
Figure 4:
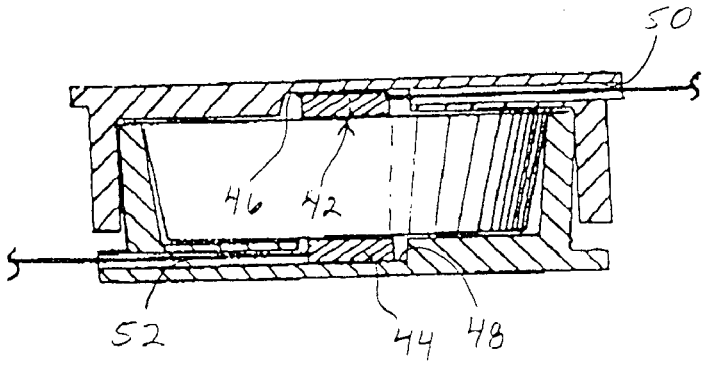
FIG. 4 is a side elevation view in cross-section of an assembled clasp in accordance with the invention.

FIG. 3 is an exploded side elevation view of the clasp 20 of the invention and FIG. 4 is a side elevation view in cross-section of the clasp 20 when the assembly is closed. The clasp 20 has been carefully designed to facilitate the ready removal and replacement of a battery 22 that provides the power for illuminating the medallion 18. The battery 22 is preferably of the nickel cadmium type characterized by an anode surface 24 of less diameter than the cathode surface 26.

The clasp 20 includes coacting upper and lower caps 28 and 30, preferably of molded plastic or other resilient material, respectively. The caps 28, 30 of the small and unobtrusive clasp 20 are particularly designed to facilitate easy access to the interior of the chamber formed therebetween for battery 22 removal and/or replacement. Each cap 28, 30 includes a rim 32 and 34, respectively, that protrudes outside the diameter of a sidewall. In the case of the upper cap 28, the rim 32 protrudes outside the outer diameter of an annular sidewall 36 while, in the case of the lower cap 30, the rim 34 protrudes outside the outer diameter of a sidewall 38.

The rims 32 and 34 greatly facilitate the ability of one to grasp the caps 28 and 30 independently. In addition, as can best be seen in FIG. 4, the clasp 20 has been carefully dimensioned so that, when closed, the sidewall 38 of the lower cap 30 is forced outwardly by the maximum outer diameter of the enclosed battery 22 so that a press-fit is obtained with the interior of the sidewall 36 of the upper cap 28. Such interaction is obtained by careful dimensioning of the inner diameter of the sidewall 38 with the dimensions of the battery 22 and the outer diameter of the sidewall 38 with the inner diameter of the sidewall 36.

In addition to the locking arrangement illustrated in FIG. 4, a tight pressure fit exists between the battery 22 and the interior of the rim 34 of the lower cap 30 that retains the battery 22 within the clasp 20 even when the two caps 28 and 30 are disengaged from one another. This permits one to use and wear the device as an ordinary piece of jewelry, unlocking the clasp 20 to remove the necklace, for example, from one's neck without concern that the battery 22 will be lost.

When battery replacement is required, this is easily accomplished by pushing a thin rod-like element upward through an aperture 40 that is provided in a bottom area of the lower cap 30 within the thickened central area of the rim 34 circumscribed by the inner circumference of the sidewall 38.

Electrodes 42, 44 are received within central recesses 46, 48 at the thickened inner surfaces of the rims 32 and 34 respectively. Each of the rims 32 and 34 includes a tunnel 50, 52 for receiving an end of the coated conductor 12 adjacent to a loop discontinuity. Referring to FIG. 4 in particular, it can be seen that the portions of the ends of the coated conductor 12 interior to the rims 32 and 34 are stripped to exposed the conductor wire 14. The wire 14 is, in each case, joined to an electrode 42 or 44, after being threaded through one of the tunnels 50, 52 by crimping with a metal crimp bead to form a flat, square contact that cannot transverse backward through the tunnel 50 or 52 as each bead assembly is much larger than the tunnel through which it was originally received. As a result, no adhesives for securing either electrodes or wires are required within the interior of the clasp 20.

Figure 5:
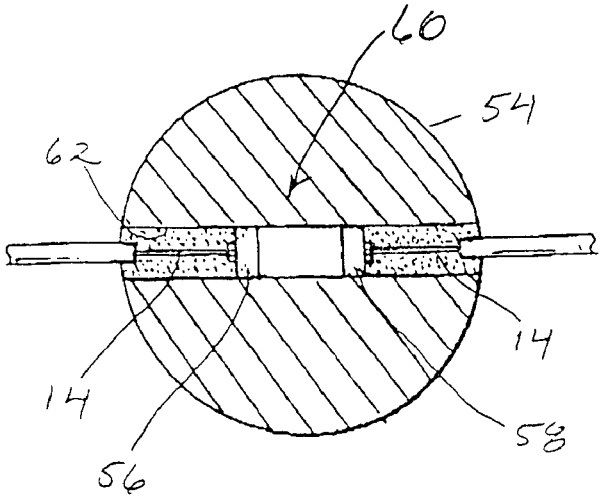
FIG. 5 is a cross-sectional view of the luminous medallion of the invention.

FIG. 5 is a cross-sectional view of the medallion 18 of the necklace 10. The medallion 18 comprises a spherical bead 54, smooth or faceted, of transparent or translucent, clear or tinted, material that receives end of the coated conductor 12 in the region of a second loop discontinuity. The ends of the coated conductor 12, stripped to expose the interior conductor wire 14, electrically contact positive and negative terminal receptors 56 and 58 of a light emitting diode (LED) 60. The LED 60 is of the surface mounted type, permitting the arrangement as shown in FIG. 5 and may comprise, for example, a device commercially available under Part No. KPT 2021 HD from Kingbright Corporation of City of Industry, Calif. Such a LED is available in red, blue, green, amber, and white. The invention is, however, not limited to such a LED.

The bead 54 of the medallion 18 includes a diametrical hole 62 forming a channel therethrough. To assemble, the LED 60 is inserted into the channel after insertion of the surface mounted LED therein with positive and negative terminal receptors 56 and 58 facing opposed channel entrances. The exposed conductor 14 at the ends of the stripped coated conductor 12 are separately inserted into the end of the channel to contact the LED 60. Once contact is made with one of the opposed terminals, an appropriate nonconductive adhesive, such as silicone glue, is injected into the channel and allowed to harden to maintain contact between that terminal and the conductor or wire 14. This process is repeated to obtain secure contact between the wire 14 and each of the terminal receptors 56 and 58, resulting in a simple, yet rugged configuration. The use of silicone glue assures that the channel will remain clear and in no way affect the appearance of the bead 54 when illuminated.

Employing a surface mounted LED 60 enables the use of a small bead-like medallion 18 that is illuminated from within. This is to be contrasted with illuminated medallion-type ornamentation that employs bullet mounted LEDs such as that taught in U.S. Pat. No. 6,122,933 issued to Stephen K. Ohlund on Sep. 26, 200 for "Jewelry Piece". Such LEDs operate at a higher voltage (requiring the use of multiple batteries and thereby necessitating a bulkier clasp) and, as in the above patent, requiring an arrangement other than the simple and durable arrangement of the invention in which wires enter into the interior of a bead to contact opposite sides of a LED. This is due to the fact that bullet-mounted LEDs are bulkier (approximately 0.75 mm vs. 3 mm in cross section) than surface mounted LEDs and the output pins of such LEDs are parallel to one another, exiting the LED from the same side. Such terminal configuration prevents the mounting of such a source wholly within a small bead as in the invention. The mounting of the light source wholly within a relatively small bead 54 generates a more brilliant and dramatic effect than possible in devices limited to indirect illumination as a consequence of the use of bullet type LED sources such as that of U.S. Pat. No. 6,122,933.

When assembled, the necklace 10 (alternatively, a bracelet may be formed with a shortened coated conductor 12) is then operable as a piece of luminous jewelry with illumination emanating through the bead 54 of the medallion 18 since the LED 60 is in electrical contact with the battery 22 power supply through the conductor 14 when the clasp 20 is closed and secured as shown in FIG. 4.

While this invention has been described with reference to its presently-preferred embodiment, it is not limited thereto. Rather, the invention is limited only insofar as it is defined by the following set of patent claims and includes within its scope all equivalents thereof.

We claim:

1. An article of jewelry comprising:

a) a flexible conductor having an exterior coating of non-conductive composition;

b) said conductor forming a loop having first and second discontinuities;

c) a clasp located within said first discontinuity;

d) a medallion located within said second discontinuity;

e) said medallion includes a body consisting of a single linear channel with a first point of entry and a second point of entry; and f) a light emitting diode located substantially within said channel in said body of said medallion, wherein said light emitting diode having a first electrode adapted to communicate with said first point of entry and a second electrode adapted to communicate with said second point of entry.

2. The article of claim 1, further comprising a conductor from one of said discontinuities in secure contact with a terminal receptor of said fight emitting diode.

3. The article of claim 1, further comprising said light emitting diode in a radially equidistant position from an exterior surface of said medallion.

4. The article of claim 3, wherein said radially equidistant position of said light emitting diode provides an even distribution of illumination.

5. The article of claim 1, wherein said light emitting diode is a surface mount light emitting diode.

6. An article of jewelry comprising:

a flexible conductor having an exterior coating of non-conductive composition;

said conductor forming a loop having first and second discontinuities;

a clasp located within said first discontinuity;

a medallion located with a second discontinuity, wherein said medallion includes a body consisting of a single piece having a property selected from a group consisting of: transparent, translucent, tinted, and combinations thereof; and said medallion consisting of a single linear channel adapted to receive a light emitting diode, wherein said light emitting diode has a first electrode adapted to communicate with a first point of entry of said linear channel and a second electrode adapted to communicate with a second point of entry of said linear channel.

7. The article of claim 6, wherein said linear channel extends from a first exterior surface of said medallion to a second exterior surface of said medallion.

8. The article of claim 6, wherein said clasp includes a housing having a first aperture adapted to receive a proximal end of said conductor from one of said loop discontinuities.

9. The article of claim 8, wherein said proximal end of said conductor is joined to an electrode with a cross sectional area greater than a cross sectional area of said first aperture.

10. The article of claim 6, further comprising a battery adapted to be in communication with said clasp.

11. The article of claim 6, wherein said light emitting diode is a surface mount light emitting diode.

12. An article comprising:

a flexible conductor forming a loop having first and second discontinuities;

a medallion located with one of said discontinuities, wherein said medallion includes a body consisting of a single piece having a property selected from a group consisting of: transparent, translucent, tinted, and combinations thereof; and a surface mount light emitting diode housed within a linear channel formed in said medallion, wherein said light emitting diode has a first electrode adapted to communicate with a first point of entry of said linear channel and a second electrode adapted to communicate with a second point of entry of said linear channel.

13. The article of claim 12, wherein said surface mount light emitting diode is adapted to emit light from within said aperture.

14. The article of claim 12, wherein said aperture extends from a first exterior surface of said medallion to a second exterior surface of said medallion.

* * * * *